US006224290B1

(12) United States Patent
Lavis

(10) Patent No.: US 6,224,290 B1
(45) Date of Patent: May 1, 2001

(54) REFLECTIVE HIGHWAY DIVIDER

(76) Inventor: Walter Lavis, 2467 Rte. 10 B-3 A-78, Morris Plains, NJ (US) 07950

( * ) Notice: Subject to any disclaimer, the term of this patent is extended or adjusted under 35 U.S.C. 154(b) by 0 days.

(21) Appl. No.: 08/898,995

(22) Filed: Jul. 24, 1997

(51) Int. Cl.[7] ..... E01F 15/00; E01F 7/00; A01K 3/00

(52) U.S. Cl. ..... 404/6; 404/9; 256/13.1

(58) Field of Search ..... 404/6, 9; 256/13.1

(56) References Cited

U.S. PATENT DOCUMENTS 3,451,319 * 6/1969 Gubela ..... 404/9
4,000,882 * 1/1977 Penton ..... 256/13.1
4,224,002 * 9/1980 Heenan et al. ..... 404/9
4,249,832 * 2/1981 Schmanski ..... 404/6
4,553,875 * 11/1985 Casey ..... 404/6
4,674,431 * 6/1987 Cory ..... 116/63 P
4,723,758 * 2/1988 Gehrig ..... 256/13.1
4,770,495 * 9/1988 Lees ..... 350/103
4,778,250 * 10/1988 McRoskey et al. ..... 350/97
5,049,001 * 9/1991 Dinitz ..... 404/7
5,104,254 * 4/1992 Durand ..... 404/6
5,160,202 * 11/1992 Legare ..... 364/153.1
5,498,101 * 3/1996 Braverman ..... 404/6
5,667,335 * 9/1997 Khieu et al. ..... 404/14

* cited by examiner

*Primary Examiner*—Eileen D. Lillis
*Assistant Examiner*—Gary S. Hartmann

(57) ABSTRACT

A highway or road divider or barrier has a reflector unit maintained within the confines of the divider or barrier to protect the reflector while being viewable when positioned parallel to the divider or barrier.

4 Claims, 2 Drawing Sheets

REFLECTIVE HIGHWAY DIVIDER

FIELD OF THE INVENTION

The present invention relates generally to a divider that may be permanent or temporary that is used in the construction of highways and road. It is especially related to a recessed reflector system for such divider to warn on comers of the existence and location of the divider.

BACKGROUND OF THE INVENTION

Presently dividers are usually cast of concrete and have attached to them, either at the point of manufacture or at the place where the divider is to be used some type of reflector to warn on comers of the existence and location of the divider. The attachment of the reflectors, however, to the divider or barrier is such that the reflector protrudes past the outer surface of the divider or barrier in order that it may be seen by on comers. This, however, creates a problem in that the reflector is therefore exposed to damage and breaking away from the divider or barrier. This causes two problems, the reflector can no longer perform their function and on comers are not warned of the existence or location of the divider or barrier. In addition, for the divider or barrier to remain in service at its present site or a future site there is the added expense of replacement of the damaged or broken off reflectors which adds to the over all maintenance or construction of roadways.

It is therefore and object of the present invention to provide a reflector system that is easily seen yet protected from damage or breaking off from the barrier or divider.

SUMMARY OF THE INVENTION

The disadvantages and limitation of the present reflector system for dividers or barriers is overcome by providing a recess in opposing longitudinal ends of the divider or barrier or at some point alone the longitudinal side of the divider or barrier for insertion, at the place of manufacture or at the placement site, the reflector within the divider or barrier. The reflector to be is one that lays flat with the longitudinal surface of the divider or barrier and has a forward and side reflective surface. In this manner the reflector is protected or shielded by the concrete of the divider or barrier on all sides while allowing on comers to see the reflector.

DETAILED DESCRIPTION OF THE PREFERRED EMBODIMENT OF THE INVENTION

Figure 1:
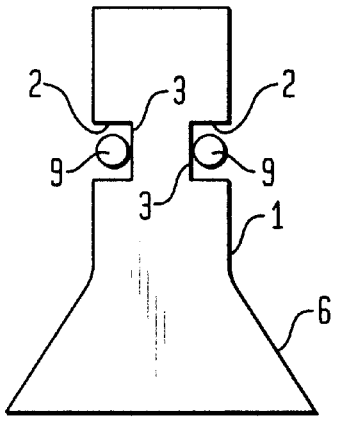
FIG. 1 is a side sectional view of the divider or barrier of through section A—A of FIG. 2.

Turning now to FIG. 1, barrier 1 has either cut into it or formed during the casting of barrier 1, cut away 2. Cut away

Figure 2:
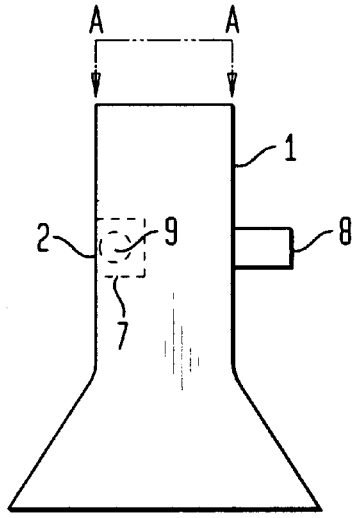
FIG. 2 is an end view of a divider or barrier having installed a prior art reflector on one side and the reflector with recess on the other side in accordance with the invention.
Figure 3:
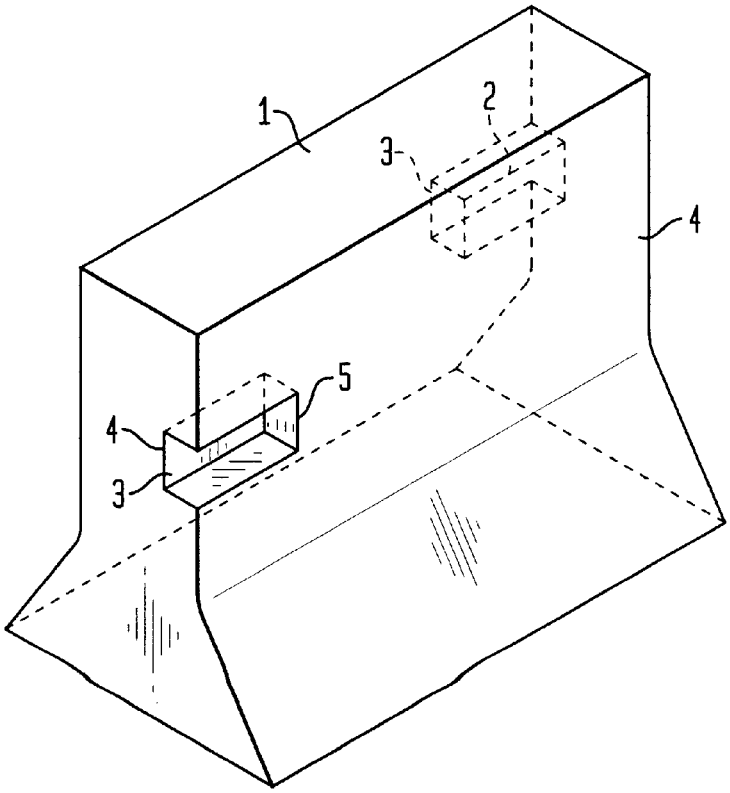
FIG. 3 is a prospective view of a concrete divider or barrier showing a reflector installed on both longitudinal end in accordance with the present invention.
Figure 4:
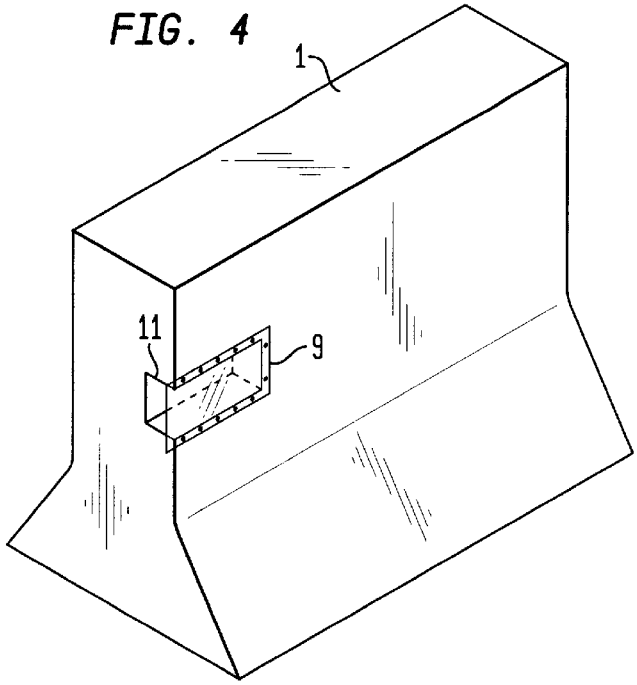
FIG. 4 is another prospective view with only one reflector installed in the longitudinal side of the divider or barrier in accordance with the present invention.

2 is tapered along surface 3 such that it is widest at end 4 of barrier 1 and is angled such that at surface 5 it is tangent with the outer surface 6 of barrier 1, see FIG. 3. In FIG. 2, the prior art reflector and mounting 8 protrudes past the surface 6 of barrier 1 thereby leaving mounting 8 open to be damaged or broken from its mounting on surface 6. Surface 7, however, which is the external mount of reflector 9 protect reflector 9 from damage or being broken from it mounting within recess 2. Since reflector 9 is within recess 2 reflector 9 is completely enclosed and protected from damage. While the end 10, see FIG. 5, of reflector 9 may be mounted flush with surface 11 of divider or barrier 1, see FIG. 4, such end 10 may also be mounted recessed from surface 11. No matter what mounting is used, reflector 9 is always protected by barrier 1 from damage since reflector 9 is surrounded by the concrete of barrier 1. In addition when two barriers 1 are put together, the two end surfaces 11 of barrier 1 totally inclose the reflector 9. However, while reflector 9 is totally enclosed by barrier 1, it is totally visible to on comers due to the fact that end 4 of cut away 2 is always larger than surface 5 of cut away 2 notwithstanding the fact that reflector 9 may be mounted at end 11 or recessed from end 11. In addition, as shown in FIG. 6, the recess 2 may be located in the middle or anywhere along the divider or barrier 1 to protect the reflector 9 from damage while providing on coming traffic with a view of the reflector 9.

Due to the fact that barriers 1 are placed end to end when they are positioned on the roadway, when one barrier 1 is abutted against the second barrier 1 a reflector 9 can always be seen no matter from which parallel direction an on comer approaches barrier 1. Depending upon if a roadway is a one way direction of travel or a two way direction of travel, reflector 9 may be placed in each recess 2 or only the recess 2 that can be seen from the direction of travel on a particular roadway.

Figure 5:
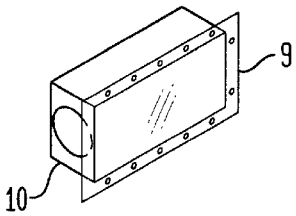
FIG. 5 is a prospective view of the reflector unit in accordance with the present invention.
Figure 6:
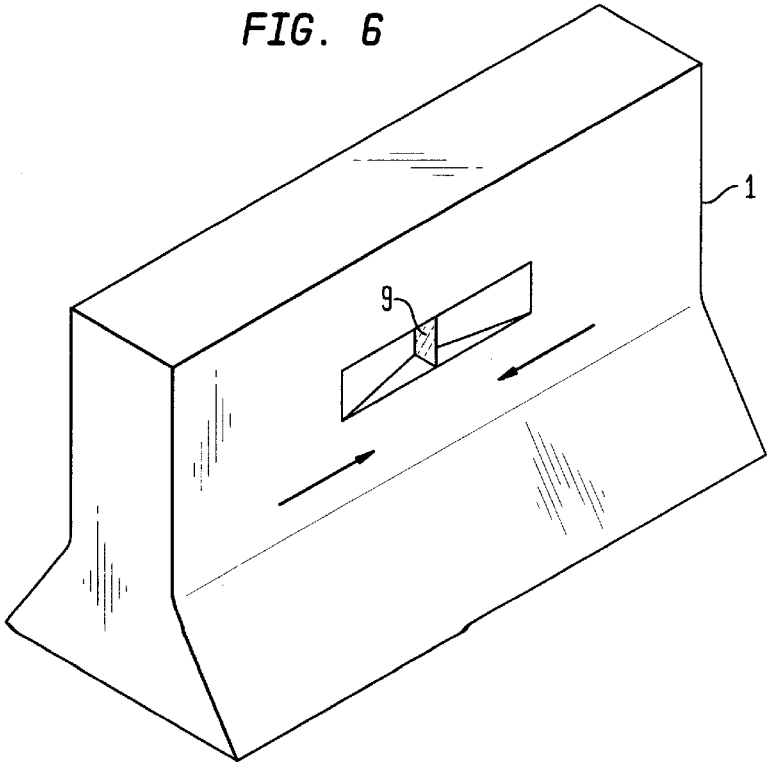
FIG. 6 is prospective view of another embodiment of the present invention with the reflector and cut out positioned in the middle of the divider or barrier for viewing in one or two directions.

Reflector 9 may be either a simple piece of reflective material that is inserted within cut away 2 or a sealed unit, as shown in FIG. 5 which substantially matches the dimensions of the cut away 2 and allows for more protection against reflector 9 becoming damaged.

While the invention has been described in accordance with the preferred embodiment, one skilled in the art may have alternative which are within the following claims of the invention and therefore the invention is not limited to the preferred embodiment, but to the invention as claimed.

I claim:

1. A road divider containing a reflective material for reflecting incident light directed thereon by an on-coming vehicle back to the vehicle, said divider having a front surface generally facing a first direction of travel of the on-coming vehicle and a side surface generally parallel to said first direction of travel, said divider comprising;

a cut away recess located solely within the side surface, the recess including front, back, upper, and lower surfaces, the front surface of the recess angled towards the first direction of travel, the back surface angled towards a second direction of travel, said second direction of travel being substantially opposite to the first direction, the upper and lower surfaces of the recess taper from a middle towards the first and second directions, wherein the reflective material is located completely within the recess at a position intermediate the upper, lower, front, and back surfaces, with neither the recess nor the reflective material breaking an outer plane of the side surface, nor changing the shape of the front surface.

2. The divider of claim 1 wherein the reflective material is a single reflector for insert into the recess.

3. The divider of claim 1 wherein the reflective material is a sealed unit for insertion into the recess.

4. A road divider containing a reflective material for reflecting incident light directed thereon by an on-coming vehicle back to the vehicle, said divider having a front surface generally facing the direction of travel of the on-coming vehicle and a side surface generally parallel to said direction of travel, said divider comprising:

a cut away recess located solely within the side surface, the recess including front, upper and lower surfaces, the front surface of the recess angled towards the direction of travel, the upper and lower surfaces of the recess taper toward the direction of travel, wherein the reflective material is located completely within the recess at a position intermediate the upper and lower surfaces, with neither the recess nor the reflective material breaking an outer plane of the side surface, nor changing the shape of the front surface.

* * * * *